US006839997B2

(12) United States Patent
Popikow

(10) Patent No.: US 6,839,997 B2
(45) Date of Patent: Jan. 11, 2005

(54) DEVICE FOR REMOVAL OF CARTRIDGES AND/OR CARTRIDGE CASINGS IN A DROP-BARREL WEAPON

(75) Inventor: Sergej Popikow, Weitnau (DE)

(73) Assignee: S.A.T. Swiss Arms Technology AG, Neuhausen (CH)

( * ) Notice: Subject to any disclaimer, the term of this patent is extended or adjusted under 35 U.S.C. 154(b) by 0 days.

(21) Appl. No.: 10/682,383

(22) Filed: Oct. 9, 2003

(65) Prior Publication Data

US 2004/0128898 A1 Jul. 8, 2004

Related U.S. Application Data

(63) Continuation of application No. PCT/EP02/03787, filed on Apr. 5, 2002.

(51) Int. Cl.[7] ..... F41A 15/00
(52) U.S. Cl. ..... 42/47; 42/48
(58) Field of Search ..... 42/47, 48, 46, 42/25

(56) References Cited

U.S. PATENT DOCUMENTS

| | | | | |
|---|---|---|---|---|
| 394,844 A | * | 12/1888 | Ellis et al. | 42/47 |
| 694,331 A | * | 2/1902 | Snyder | 42/48 |
| 730,862 A | * | 6/1903 | Bartholmes | 42/47 |
| 803,277 A | * | 10/1905 | Ellstrom | 42/47 |
| 1,504,137 A | * | 8/1924 | Boniface | 42/47 |
| 3,803,740 A | * | 4/1974 | Martial | 42/48 |
| 3,984,933 A | * | 10/1976 | Ruger | 42/47 |
| 4,121,364 A | * | 10/1978 | Kaltenegger | 42/32 |
| 5,109,621 A | | 5/1992 | Blaser | |
| 5,459,956 A | | 10/1995 | Rowlands et al. | |
| 5,469,649 A | * | 11/1995 | Rowlands et al. | 42/43 |

FOREIGN PATENT DOCUMENTS

| | | |
|---|---|---|
| FR | 722 481 A | 3/1932 |
| FR | 756 625 A | 12/1933 |
| GB | 22513 A | 1/1914 |
| GB | 819 800 A | 9/1959 |

* cited by examiner

*Primary Examiner*—Jack Keith
*Assistant Examiner*—M. Thomson
(74) *Attorney, Agent, or Firm*—Martin Fleit; Paul D. Bianco; Fleit Kain Gibbons Gutman Bongini & Bianco, P.L.

(57) ABSTRACT

Device for removal of cartridges and/or cartridge casings in a drop-barrel weapon having at least one cartridge ejector axially displaceable in a barrel part for removal of unfired cartridges and an ejector mechanism acting on the cartridge ejector for ejection of spent cartridge casings. The ejector mechanism has a locking pin, displaceable in the cartridge ejector, for releasable locking of the cartridge ejector in the barrel part. A guide pin is arranged in the cartridge ejector that engages on the cartridge ejector via a compression spring arranged in the interior of the cartridge ejector and can be displaced by a tension slide arranged on barrel part.

9 Claims, 6 Drawing Sheets

C
C

B
1
2
16
17
21
22
24
25
26
27
31
37
42
52
58
59
60
61

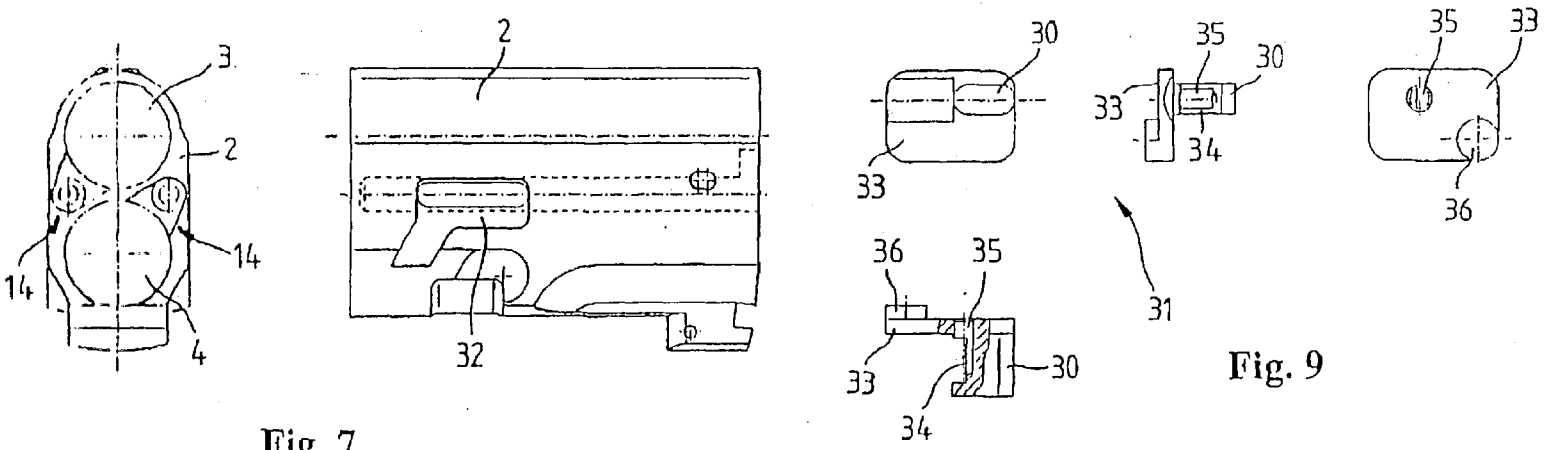
Fig. 9
Fig. 7
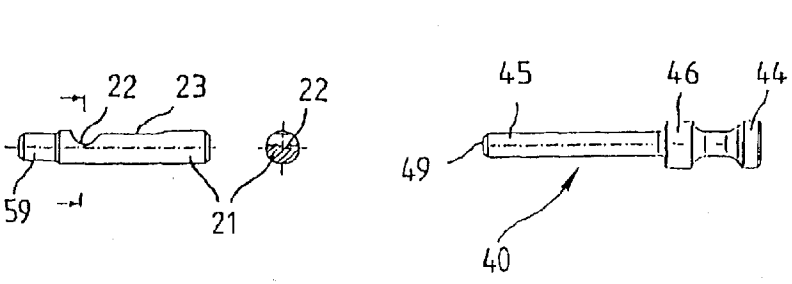
Fig. 11
Fig. 10
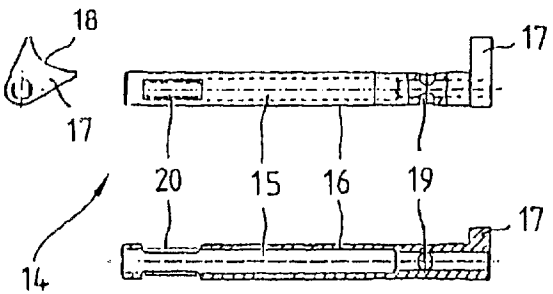
Fig. 8

DEVICE FOR REMOVAL OF CARTRIDGES AND/OR CARTRIDGE CASINGS IN A DROP-BARREL WEAPON

RELATED APPLICATION

This application is a continuation of International Patent Application No. PCT/EP02/03787, filed Apr. 5, 2002 the contents of which are here incorporated in their entirety.

BACKGROUND OF THE INVENTION

1. Field of the Invention

The present invention relates to a device for removal of cartridges and/or cartridge casings in a drop-barrel weapon.

2. Prior Art

This type of device is known, for example, from DE-PS 498 943. There, a cartridge ejector, axially slidable in the barrel part of a drop-barrel weapon, is operated by an ejector hammer attached to rotate in the front part of the bascule. When the weapon is opened with the striking-pin piece already having been struck, rotation of the ejector hammer occurs by an ejector lever attached in the front shaft, which is acted upon by an ejector spring in the form of a leaf spring, also arranged in the front shaft and tightened during closure of the weapon. The ejector lever is rotated by the end of a cocking rod pushed by the striking-pin piece and, after reaching a certain position of rotation, is accelerated abruptly under the influence of the ejector spring, so that rapid rotation of the ejector hammer and displacement of the cartridge ejector to eject the spent cartridge is produced. If, however, the weapon is opened without the striking-pin piece having been struck, the ejection movement of the cartridge ejector only acts against an edge of the bascule by striking an extension of the ejector hammer. An unfired cartridge is withdrawn only slightly from the chamber for easier removal, whereas a fired cartridge is ejected. However, a relatively demanding operating mechanism in the front shaft is required in this type of cartridge ejector. Therefore, the manufacture of such drop-barrel weapons is costly and their assembly is also made difficult. Since the ejector springs are also already compressed during closure of the barrel part, they are generally under tension for a longer period, so that their service life, and therefore the function of the ejectors, may be adversely affected.

SUMMARY OF THE INVENTION

The problem in the art is to devise an apparatus of the initially mentioned type that has a compact design with few parts and can be simply installed. This problem is solved by the present invention by providing a device with the features as disclosed and described herein. Advantageous embodiments and expedient variants of the invention can be understood from the present disclosure.

A significant advantage of the device according to the invention is that the entire mechanism is accommodated in the breech and barrel part in particularly space-saving and compact fashion. Connections, demanding in design, and release mechanisms are not required in the front shaft. Therefore, the barrel can be simply removed and reattached in weapons that can be broken down. Weapon manufacture is also simplified and assembly can be facilitated. The particularly simple-to-install device also serves as cartridge ejector for simpler removal of unfired cartridges, and also as a cartridge ejector, through which spent cartridge casings are ejected during opening of the breech.

Another advantage of the device according to the invention is that the compression spring for the ejector mechanism is only tightened during pivoting of the barrel part. In this way, the compression springs are less stressed, so that their service life can be extended. In weapons with several barrels, the ejector mechanism can be made from identical parts for each of the barrels. Thus, the manufacturing costs are reduced and parts storage is simplified.

BRIEF DESCRIPTION OF THE DRAWINGS

Additional details and advantages of the invention are apparent from the following description of a preferred embodiment example with reference to the drawing. In the drawing:

FIG. 7 shows a side view and a rear view of the barrel part;

FIG. 8 shows a side view and a longitudinal section of a cartridge ejector;

FIG. 9 shows a tension slide of the ejector mechanism in different views;

FIG. 10 shows a locking pin of the ejector mechanism in a side view and in cross section;

FIG. 11 shows an ejector firing pin of the ejector mechanism in a side view.

DETAILED DESCRIPTION OF PREFERRED EMBODIMENTS OF THE INVENTION

Figure 1:
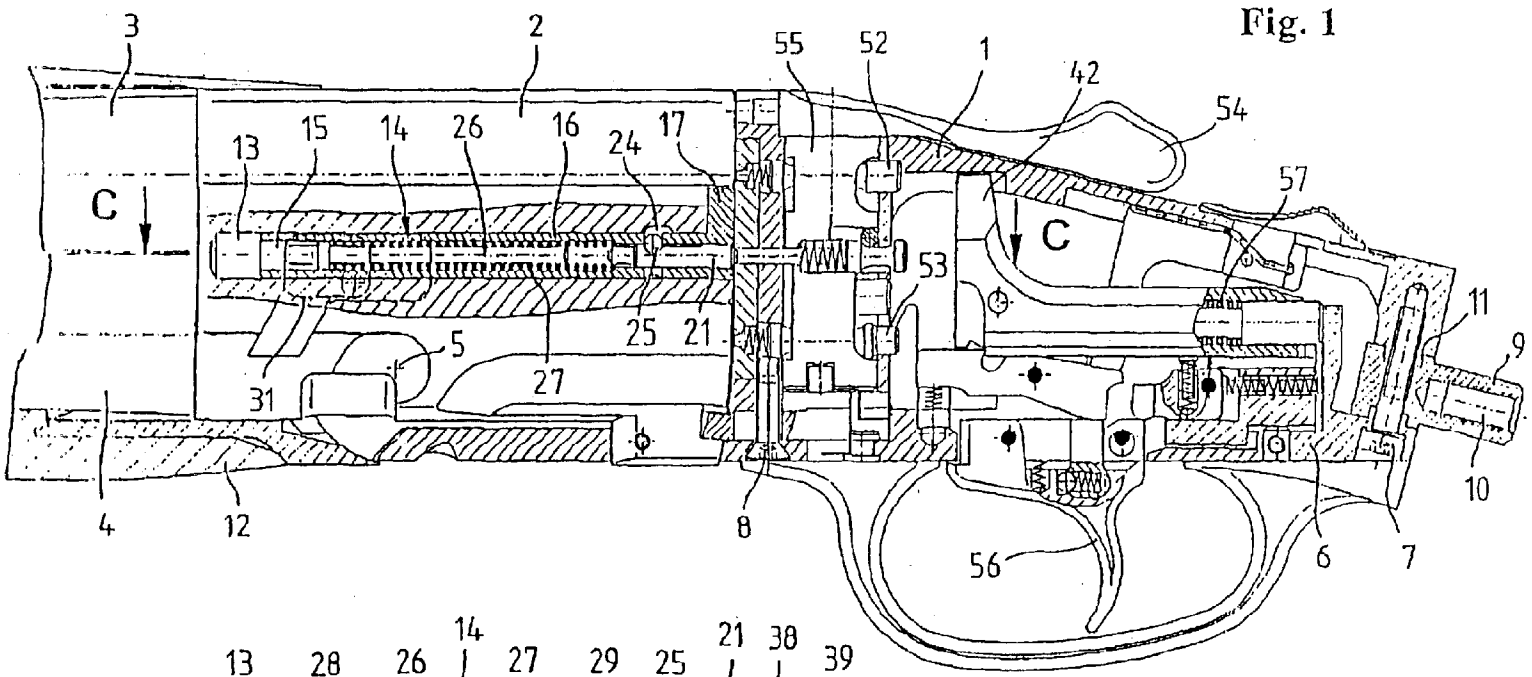
FIG. 1 shows a partial cutaway side view of a system housing and barrel part of a drop-barrel weapon with an ejector mechanism with the trigger still inactivated.

The partial view of the multibarrel drop-barrel weapon shown in FIG. 1 contains a breech housing 1, on which a barrel part 2 with two barrels 3 and 4, lying one above the other, is arranged pivotable via a lateral turning knuckle 5. On the bottom of the breech housing 1, a main plate 6 with the lock parts arranged thereon is releasably attached via fastening screws 7 and 8. On the rear part of the breech housing 1, a shoulder piece 9 is provided for releasable fastening of a rear shaft (not shown). The shoulder part 9 provided with a threaded hole 10 is releasably fastened via a groove connection 11 between the breech housing 1 and the main plate 6 via fastening screw 7. A front shaft 12 is arranged to be removable on barrel part 2. The connections between the corresponding parts are designed so that the drop-barrel weapon, if required, can be simply broken down and again reassembled.

Two adjacent guide holes 13 to receive a cartridge ejector 14 for each of the barrels 3 and 4 are arranged in barrel part 2. As follows for FIG. 2 and the rear view of barrel part 2 shown in FIG. 7, the two identically designed cartridge ejectors 14 are arranged below and above the two barrels 3 and 4 and offset to their left and right.

The cartridge ejector 14 shown in detail in FIG. 8 is provided with a central through-hole 15 and has a cartridge ejector rod 16 that is axially displaceable in the corresponding guide hole 13, as well as a cartridge ejector plate 17 arranged on its rear end. The cartridge ejector plate 17 is provided with a rounding 18 and designed for engagement on the laterally protruding cartridge edge. A transverse through-hole 19 is provided in the rear part of cartridge ejector rod 16 abutting the cartridge ejector plate 17, and a lateral passage 20 is provided in the front part in the form of an elongated hole. In the rear part of the through-hole 15, a locking pin 21, shown separately in FIG. 10, is guided to be axially displaceable. This has a lateral catch recess 22 and a lateral flattening 23 connected to it for engagement of a catch ball 25 arranged in the transverse hole 19 of cartridge ejector rod 16. As shown particularly in FIG. 5, the catch ball 25 is arranged so that it is disengaged relative to the catch recess 22, when locking pin 21 is pushed into the cartridge ejector 14 and is forced into a recess 24 in barrel part 2.

As can be seen, particularly from 2, an axially displaceable guide pin 26 and a cylindrical coil-compression spring 27 coaxial thereto is arranged in the front part of the through-hole 15 of the two cartridge ejectors 14, and the spring is compressed between a widened head 28 of guide pin 26 and a contact shoulder 29 on the inside in the rear region of through-hole 15. The two guide pins 26 lie with their head 28 on a shoulder 30 protruding into passage 20 of cartridge ejector rod 16 on corresponding tension slides 31 that are displaceable on both sides of barrel piece 2 in corresponding holes 32.

The tension slide 31, shown in several views in FIG. 9, contains an essentially rectangular plate 33 that is displaceable in the passage 32, also shown in FIG. 7, parallel to barrels 3 and 4. The shoulder 30 on plate 33 protruding into the elongated passage 20 in the cartridge ejector rod 16 is arranged with a milled recess 34, in which the head 28 of the guide pin 26 stops. A lateral disassembly hole 35 that is not further explained leads to the milled recess. An outwardly protruding cam 36 that engages with a recess 37, shown in FIG. 4, on a lateral cheek in the front part of the breech housing 1 is situated on the side of plate 33 opposite shoulder 30. Cam 36 on the tension slide 31 and the oblique recess 37 are arranged so that the tension slide 31 moves rearward during pivoting of the barrel part 2 within the window-like perforation 32, in which the guide pin 26 is pushed in the direction of locking pin 21.

Figure 2:
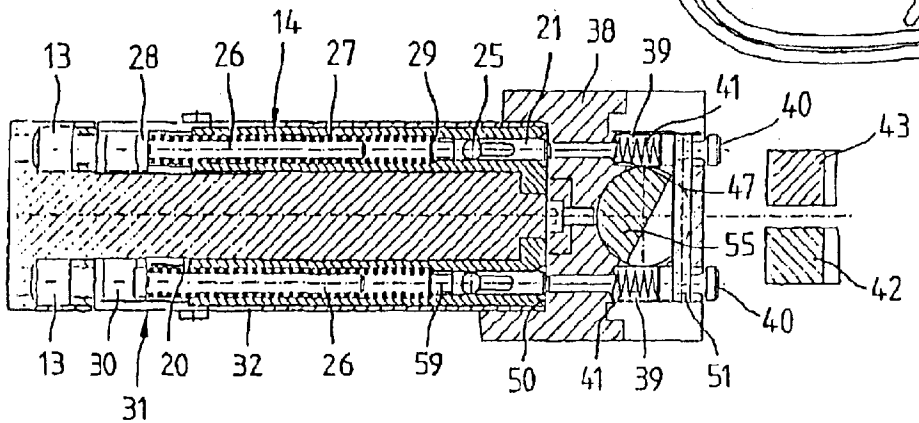
FIG. 2 shows a cross sectional view in the direction of arrow C—C of FIG. 1.

Two adjacent receiving holes 39 are arranged in a vertical block 38 of the breech housing 1 according to FIG. 2, so that they are aligned in the closed barrel part 2 coaxial with the locking pins 21 in the corresponding cartridge ejector 14. An ejector firing pin 40 is axially displaceable in each of the two receiving holes 39 and is forced by a spring 41 into a reset position.

The ejector firing pin 40, shown separately in FIG. 11, has a rear end 44 operable by striking-pin pieces 42 and 43 of a bolt and a front end 45 designed for displacement of the locking pin 19. The two ejector firing pins 40 are forced by the spring 41 arranged between a collar 46 on an ejector firing pin 40 and a stop surface 47 on the vertical block 35 into a reset position, in which the front end 49 of the ejector firing pin 40 is closed off with a front closure surface 50 of the vertical block 38. The two ejector firing pins 40 are secured against falling out by a common transverse pin 51, which is inserted into a corresponding transverse hole in the breech housing 1 and engages in an intermediate region with reduced cross section lying between collar 46 and the rear end of the ejector firing pin.

The two firing pins 52 and 53 for firing of the cartridges arranged in the upper and lower barrels are also arranged above and below the two ejector firing pins 40. The two striking-pin pieces 42 and 43, individually operable, are shaped so that during the operation of the firing pins 52 and 53 belonging to the upper and lower barrels, they simultaneously also force the locking pin 21 inward in the cartridge ejector 14 associated with this barrel. A breech shaft 55, operable by a lever 54, is arranged between the two ejector firing pins 40.

Figure 3:
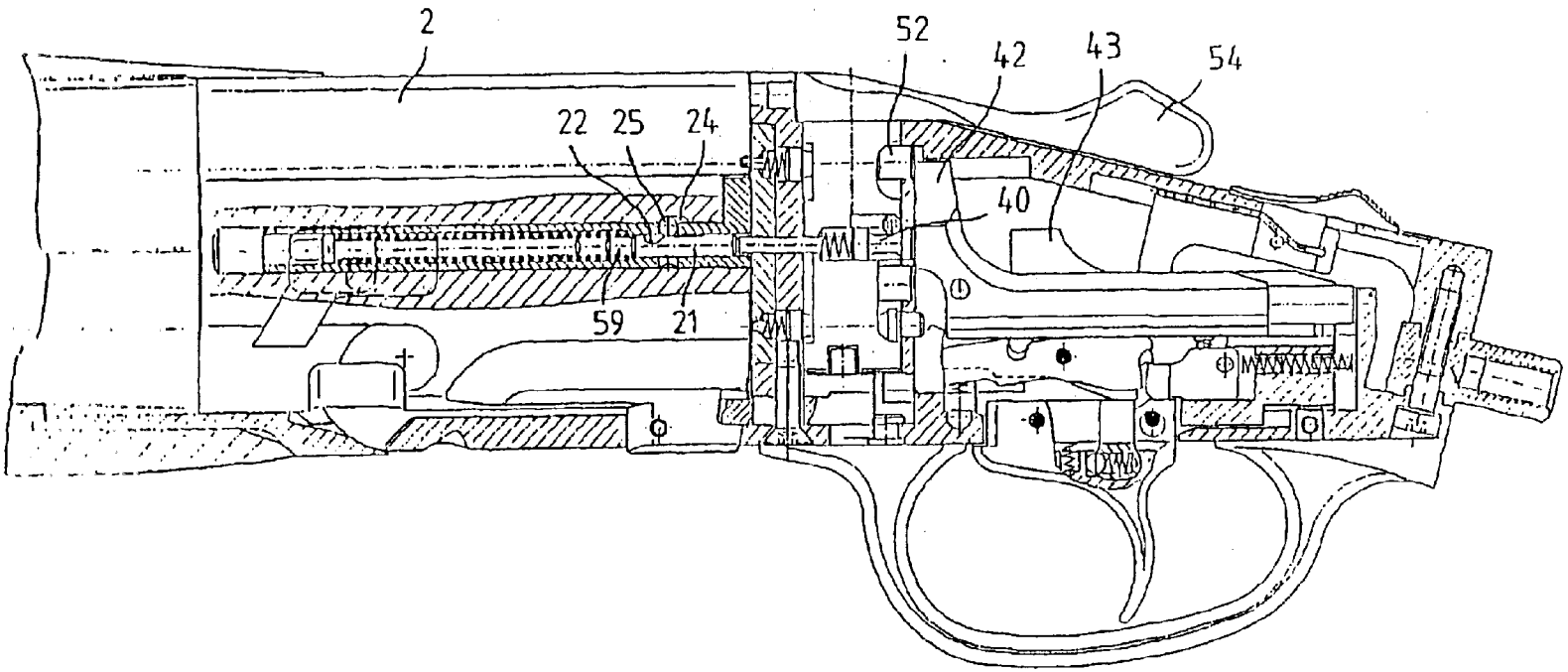
FIG. 3 shows a partial cutaway side view of the system housing and barrel part with the ejector mechanism after operation of the trigger to fire a shot from the upper barrel and a still unopened barrel part.

The method of operation of the device according to the invention is explained below with reference to FIGS. 1 to 5:

In the state shown in FIG. 1, in which the barrel part 2 is closed and the two striking-pin pieces 42 and 43 have still not been struck, the two ejector firing pins 40 and the two firing pins 52 and 53 are situated in the reset position shown. When the trigger 56 of the trigger device, designed as a single trigger system in the version shown, is activated, the one striking-pin piece 42 being initially released and pushed forward by a striking spring 57, as shown in FIG. 3. The ejector firing pin 40 is operated by the striking-pin piece 42, in addition to the firing pin 52 acting on the cartridge, and forces the locking pin 21 inward. The catch ball 25 is pushed outwards from the catch recess 22 into recess 24. During the pressing on locking pin 21, an end pin 59 formed on its front end is also pushed into the rear end of the coil-compression spring 27. The diameter of the end pin 59 is chosen so that it is firmly clamped within the cylindrical coil-compression spring 27, so that the locking pin 21 also retains its pushed-in position, when the bolt of the drop-barrel weapon is opened by operating lever 54 and the barrel part 2 is pivoted into the half-opened position shown in FIG. 4.

Figures 4, 5:
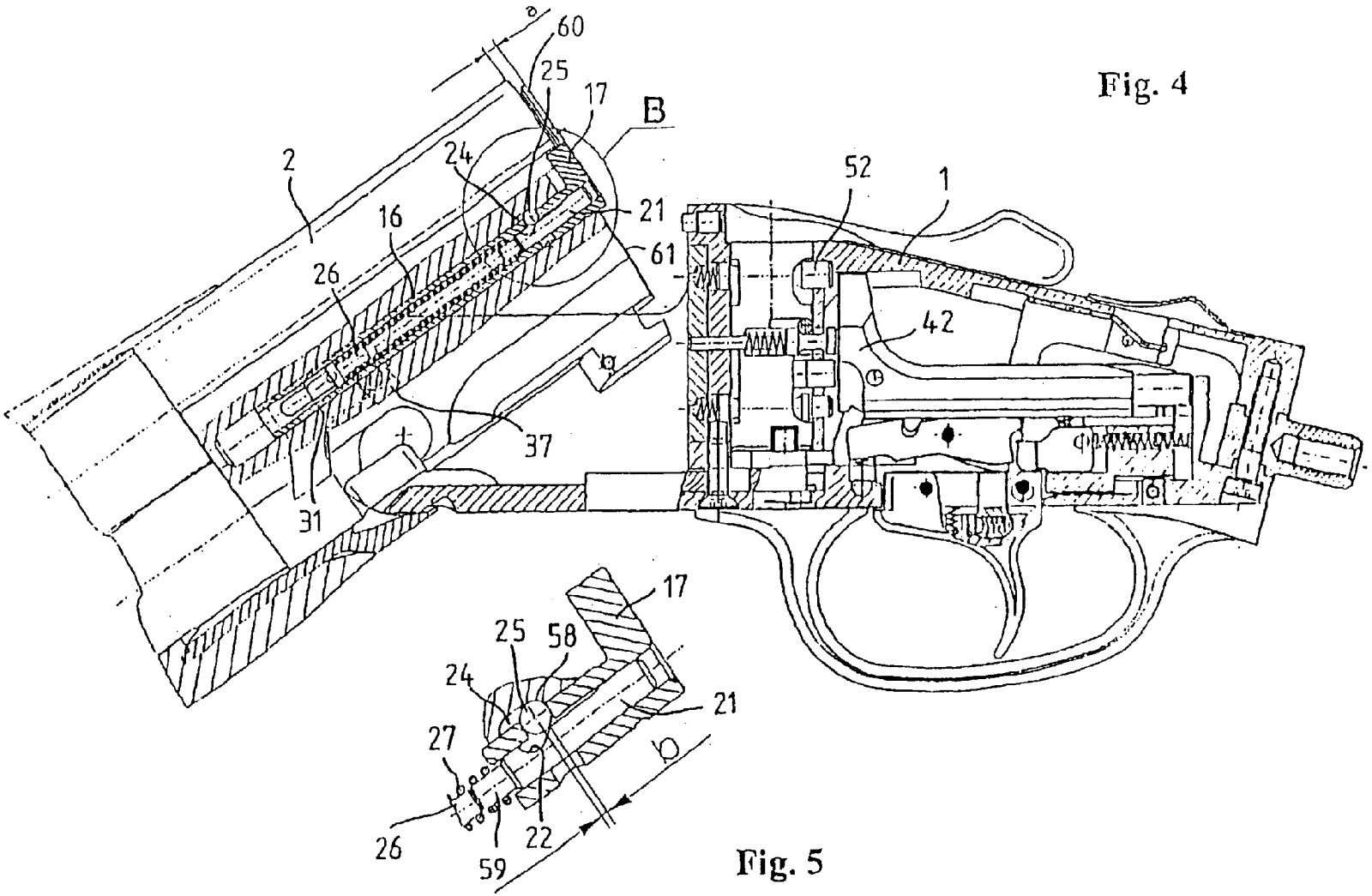
FIG. 4 shows a partial cutaway side view of the system housing and barrel part with the barrel part still not fully pivoted after operation of the trigger.
FIG. 5 shows an enlarged view of section B in FIG. 4.

During pivoting of barrel part 2 into the half-opened position according to FIG. 4, the guide pin 26 is pushed by the tension slide 31 in the direction of locking pin 21. Displacement of the tension slide 31 occurs by engagement of the cam 36 arranged on the tension slide 31 into the obliquely running recess 37 on the breech housing 1. The cartridge ejector rod 16 is carried rearward by the guide pin 26 via coil-compression spring 27 until the catch ball 25 reaches a stop on a rear surface 58 of recess 24, as shown in FIG. 5. The fired cartridge 60 is then pushed out from the cartridge ejector plate 17 by a small amount a relative to the rear face 61 of barrel part 2. As soon as the locking bolt 25 stops on surface 58, the coil-compression spring 27 is tightened by the guide pin 26 pushed further back during pivoting of the barrel part 2 via tension slide 31. The length of the guide pin 26 is adjusted so that its rear end in the half-opened position of barrel part 2 stops on the front end of the pushed-in locking pin 21 and the catch ball 25 remains in the locking position according to FIG. 5.

Figure 6:
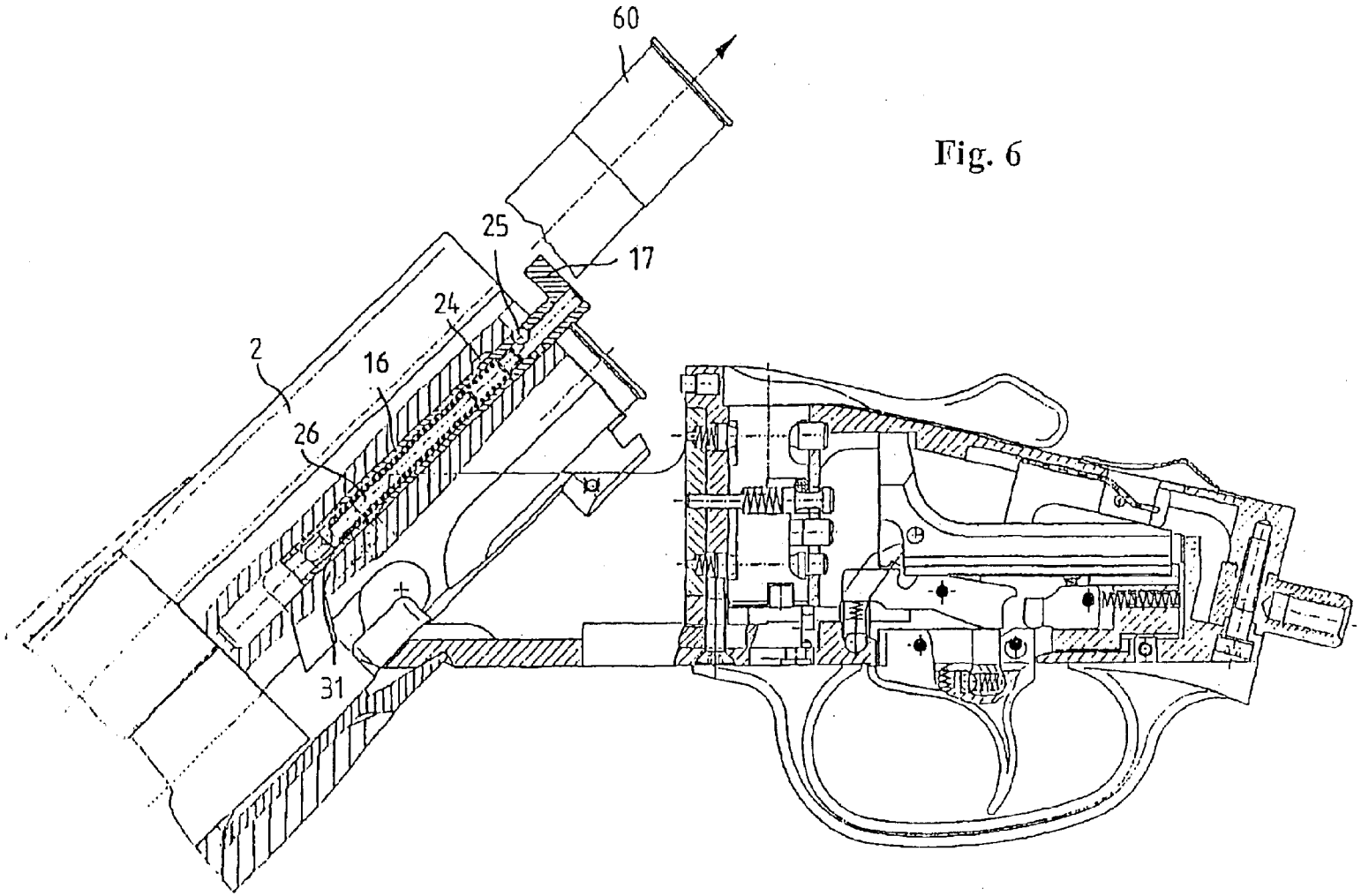
FIG. 6 shows a partial cutaway side view of the system housing and barrel part with the ejector mechanism after operation of the trigger and a fully pivoted barrel part.

When the barrel part 2 is pivoted from the half-opened position shown in FIG. 4 further downward into the fully opened position according to FIG. 6, the tension slide 31 is also moved into its fully retracted position. Thus, the guide pin 26 is pushed back, carrying along the locking pin 21. The catch ball 25 falls back into the catch recess 22 and locking of the cartridge ejector 14 is released. By the action of the tightened coil-compression spring 27, the cartridge ejector 14 is then forced out slightly, so that the cartridge casing of the fired cartridge is automatically ejected. The ejection movement of the cartridge ejector 14 is limited by the stop of the cartridge ejector rod 16 on the shoulder 30 of tension slide 31 protruding into the elongated passage 20. The length of the guide pin 26 must be chosen so that locking of the cartridge ejector is only released when the cartridge casing can pass by the breech housing.

If, however, one or both cartridges are not fired, the corresponding ejector firing pin 40 is not operated, so that the corresponding locking pin 21 is not pushed into the cartridge ejector rod 16. The locking pin 21 remains in the position shown in FIG. 1, in which the catch ball 1 lies in the catch recess 22 of locking pin 21. In this position, the cartridge ejector rod 14 is not locked relative to barrel part 2 and can be pushed out from the barrel part by the guide pin 26 pushed during pivoting of the barrel via tension slide 31, without pretensioning the coil-compression spring 27.

Figure 12:
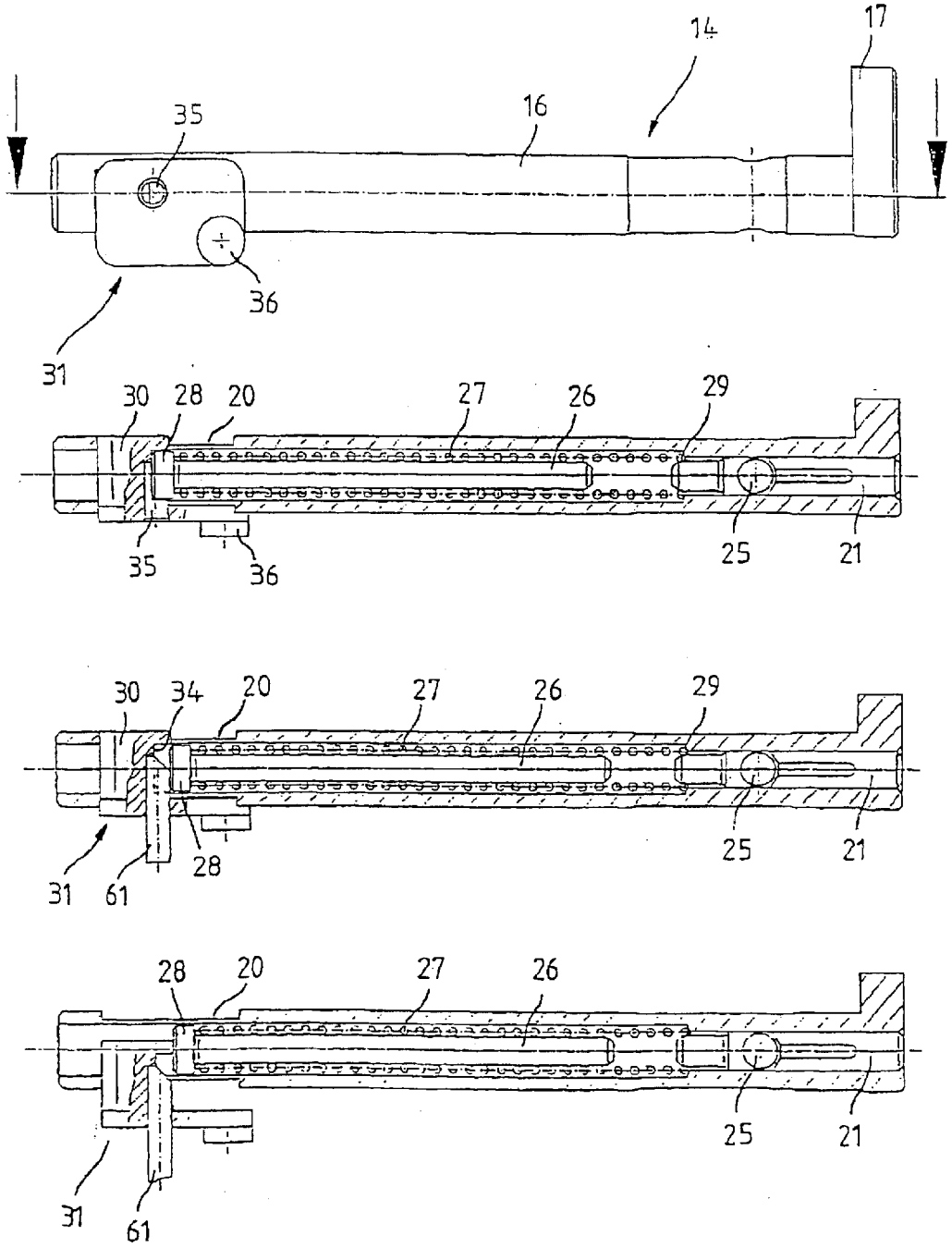
FIG. 12 shows a view to explain disassembly of the ejector mechanism.

With the aforementioned features, a simply designed ejection device is formed with an integrated ejector mechanism. The device according to the invention can be mounted extremely compactly and simply and is easily disassembled. Disassembly is explained below with reference to FIG. 12.

Initially, a disassembly pin 61 beveled on the front is introduced into the disassembly hole 35, so that the head 28 of guide pin 26 is pushed rearward and is disengaged relative to milled recess 34 on the shoulder 30 of tension slide 31 protruding into the passage 20 of cartridge ejector rod 16. In this position, the tension slide 31 can be disassembled by slightly pivoting the disassembly pin. The cartridge ejector 14 can then be pulled rearward from hole 13 in barrel part 2, together with the compression spring 27, catch ball 25 and locking pin 21.

The invention is not restricted to multibarrel drop-barrel weapons, but can also be used for single barrel drop-barrel weapons. The device according to the invention is particularly usable in double-barrel skeet or trap weapons in the sporting field, or also in hunting weapons.

What is claimed is:

1. Device for removal of cartridges and/or cartridge casings in a drop-barrel weapon, with at least one cartridge ejector axially displaceable in a barrel part for removal of unfired cartridges and an ejector mechanism acting on the cartridge ejector for ejection of spent cartridge casings, comprising the ejector mechanism has a locking pin, displaceable in the cartridge ejector, for releasable locking of the cartridge ejector in the barrel part, and a guide pin arranged in the cartridge ejector that engages on the cartridge ejector via a compression spring arranged in the interior of the cartridge ejector and can be displaced by a tension slide arranged on the barrel part, the locking pin being displaceable via an ejector firing pin operated by a striking pin piece into an advanced position, in which the cartridge ejector is locked relative to the barrel part via a locking mechanism, and the locking pin having a front end pin, via which, during full pivoting of the barrel part, the locking pin is pushed back by the guide pin into its rear position, in which locking of the cartridge ejector is released relative to the barrel part by the locking mechanism.

2. Device according to claim 1, wherein the locking pin and a guide pin are arranged in a central through-hole of cartridge ejector.

3. Device according to claim 1, wherein, arranged in a transverse hole of cartridge ejector, the locking mechanism includes a catch ball which is pushed into a recess in the barrel part or into a catch recess of the locking pin, depending on the position of the locking pin.

4. Device according to claim 1, wherein the ejector firing pin is arranged in a receiving hole in the breech housing, aligned coaxially with the locking pin when the barrel part is closed.

5. Device according to claim 1, wherein the tension slide is arranged to be movable in a lateral passage on the barrel part.

6. Device according to claim 1, wherein the tension slide contains a laterally protruding shoulder for engagement in a passage of the cartridge ejector and a cam protruding opposite shoulder for engagement in a lateral recess in the front part of a breech housing.

7. Device according to claim 1, wherein the compression spring is compressed between a head of the guide pin and an internal stop shoulder of the cartridge ejector.

8. Device according to claim 1, wherein in a drop-barrel weapon with several barrels, a separate cartridge ejector with an ejector mechanism is provided for each of the barrels.

9. Device according to claim 8, wherein the cartridge ejectors in a drop-barrel weapon with two barrels lying one above the other, are arranged beneath or above the two barrels or offset to their left or right.

* * * * *